US011779999B2

(12) United States Patent
Wolfarth et al.

(10) Patent No.: US 11,779,999 B2
(45) Date of Patent: Oct. 10, 2023

(54) METHOD FOR PRODUCING A CONNECTING ELEMENT, CONNECTING ELEMENT, AND ROLLING TOOL

(71) Applicant: Arnold Umformtechnik GmbH & Co. KG, Forchtenberg-Ernsbach (DE)

(72) Inventors: Uwe Wolfarth, Langenburg (DE); Bernd Werthwein, Forchtenberg (DE)

(73) Assignee: Arnold Umformtechnik GmbH & Co. KG

( * ) Notice: Subject to any disclaimer, the term of this patent is extended or adjusted under 35 U.S.C. 154(b) by 52 days.

(21) Appl. No.: 16/769,478

(22) PCT Filed: Nov. 19, 2018

(86) PCT No.: PCT/EP2018/081769
§ 371 (c)(1),
(2) Date: Jun. 3, 2020

(87) PCT Pub. No.: WO2019/110287
PCT Pub. Date: Jun. 13, 2019

(65) Prior Publication Data

US 2020/0384524 A1 Dec. 10, 2020

(30) Foreign Application Priority Data

Dec. 7, 2017 (DE) ..... 102017222146.1

(51) Int. Cl.
*B21H 3/06* (2006.01)
*B21H 1/18* (2006.01)
*B21H 1/14* (2006.01)

(52) U.S. Cl.
CPC ..... *B21H 3/06* (2013.01); *B21H 1/18* (2013.01); *B21H 1/14* (2013.01)

(58) Field of Classification Search
CPC ... B21H 1/00; B21H 1/14; B21H 1/18; B21H 1/20; B21H 3/06; B21B 1/088;
(Continued)

(56) References Cited

U.S. PATENT DOCUMENTS 1,337,640 A * 4/1920 Canda ..... B21H 1/14 72/338
1,469,174 A * 9/1923 Blakeslee ..... B21H 1/18 72/71

(Continued)

FOREIGN PATENT DOCUMENTS

CN 103111563 A 5/2013
CN 104707865 A 6/2015

(Continued)

*Primary Examiner* — Debra M Sullivan
*Assistant Examiner* — Matthew Stephens
(74) *Attorney, Agent, or Firm* — Boyle Fredrickson, S.C.

(57) ABSTRACT

The invention relates to a method for producing a connecting element comprising at least two ball-like sections, wherein two ball-like sections are directly adjacent to each other, or wherein two ball-like sections are connected to each other by means of a connecting section, wherein the rolling of a single-piece blank, which is cylindrical at least in sections, between at least two rolling tools and the shaping of the at least two ball-like sections and optionally of the connecting section during the rolling are provided.

9 Claims, 2 Drawing Sheets

(58) Field of Classification Search
CPC ..... B21B 1/0883; B21B 1/085; B21B 1/08; B21B 1/12
See application file for complete search history.

(56) References Cited

U.S. PATENT DOCUMENTS

| | | | | | |
|---|---|---|---|---|---|
| 1,525,223 | A * | 2/1925 | Ferdinand | B21H 1/14 | 72/71 |
| 3,206,828 | A * | 9/1965 | Kikuchi | B21H 1/14 | 29/899 |
| 4,489,581 | A * | 12/1984 | Davidovich | B23P 15/00 | 72/70 |
| 7,278,286 | B2 | 10/2007 | Taniguchi et al. | | |
| 9,873,186 | B2 | 1/2018 | Herzinger | | |
| 2007/0022795 | A1* | 2/2007 | Taniguchi | B21H 3/06 | 72/88 |

FOREIGN PATENT DOCUMENTS

| | | |
|---|---|---|
| DE | 3229605 | 4/1983 |
| GB | 2108881 A | 5/1983 |

* cited by examiner

METHOD FOR PRODUCING A CONNECTING ELEMENT, CONNECTING ELEMENT, AND ROLLING TOOL

FIELD OF THE INVENTION

The invention relates to a method for producing a connecting element comprising at least two ball-like sections, wherein two ball-like sections are directly adjacent to each other, or wherein two ball-like sections are connected to each other by means of a connecting section.

BACKGROUND

A connecting element comprising two ball-like sections is known from German laid-open application DE 10 2011 087 286 A1. The ball-like sections are directly adjacent to each other. The connecting element is intended to be produced very simply and cost-effectively from mass-produced individual balls which merely have to be connected to one another. The individual balls can be connected to form the connecting element by welding, for example. Clip elements are then attached to the ball-like sections, the clip elements in turn being connected to one of the components to be connected to one another. It is also provided to link more than two balls together to form a connecting element.

SUMMARY

The intention with the invention is to provide an improved method for producing a connecting element, an improved connecting element and an improved rolling tool for producing a connecting element.

For this purpose, according to the invention, a method is provided for producing a connecting element comprising at least two ball-like sections, wherein two ball-like sections are directly adjacent to each other, or wherein two ball-like sections are connected to each other by means of a connecting section, wherein the rolling of a single-piece blank, which is cylindrical at least in sections, between at least two rolling tools and the shaping of the at least two ball-like sections and optionally of the connecting section during the rolling are provided.

Surprisingly, a connecting element comprising at least two ball-like sections can be produced by a single cold forming process. As a result, the welding provided in the prior art of the ball-like sections to form the connecting element can be dispensed with and the ball-like sections and also the connection of the ball-like sections are produced in a single working step. The rolling of a cylindrical blank has surprisingly managed to achieve a very high degree of deformation, thus enabling the two ball-like sections to be shaped. The connecting element produced according to the invention can thereby reliably carry out its designated function, namely of being latched with a clip element. The rolling tools provided can be roller-type rolling tools or two flat rolling jaws. The blank is preferably circular-cylindrical. The blank can be separated from a wire coil by the rolling tool or a separate separating device. This facilitates the handling of the blank. The rolling makes it possible for the ball-like shape to differ from a ball shape and, for example, makes it possible to produce rotationally symmetrical shapes which, for example, are more bulbous than balls and, as a result, if required, more material can be made available for pressing operations. This may be advantageous if the ball-like sections are pressed directly into through openings in metal sheets and, in order to secure the pressed-in position, projections are pressed out of the ball-like section and then protrude out of the ball-like section above and below the metal sheet.

In a development of the invention, the shaping takes place over the course of 10 to 15 revolutions of the blank.

10 to 15 revolutions of the blank relative to the rolling tool are sufficient for forming the at least two ball-like sections and optionally connecting sections between the ball-like sections from a cylindrical, in particular circular-cylindrical, blank. As a result, connecting elements can be produced rapidly and in large piece numbers with the method according to the invention. The connecting elements can be produced from a blank without waste, i.e. without slugs.

In a development of the invention, the cutting off of a respective slug from the respective outer ends of the ball-like sections at the end of the rolling operation takes place by means of a separating edge on a rolling tool, wherein the separating edge extends beyond the center longitudinal axis of the connecting element.

Rolling of the blank generally gives rise to slugs which receive excess material of the blank that is not required for producing the connecting element. Such a slug arises, for example, by the fact that the blank initially has to be held at one of its ends as it is being placed into the rolling tool. This slug or else two slugs at the opposite ends of the nearly finished connecting element can then be cut off automatically according to the invention by means of a separating edge on a rolling tool. The connecting element can thereby be completely produced by means of rolling and, as a rule, no more refinishing work is required.

In a development of the invention, the holding of the blank at least before the beginning of the rolling is provided at a supply head of the blank, wherein the supply head is disk-like and projects in the radial direction over the blank which is cylindrical except for the supply head.

Such a disk-like supply head facilitates the holding of the blank before the beginning of the rolling and therefore also the inserting of the blank into the rolling tool.

In a development of the invention, the cutting off of the supply head takes place together with cutting off one of the slugs.

The connecting element can therefore be completely manufactured by means of a single rolling operation.

In a development of the invention, the blank has a circular-cylindrical basic body.

The blank can be designed, for example, as a piece of wire and in particular a disk-like supply head can be produced by upsetting the piece of wire.

In a development of the invention, two flat rolling jaws are provided as the rolling tools.

The connecting element can be produced in large piece numbers and with low tolerances by means of flat rolling jaws.

In a development of the invention, each flat rolling jaw has two channel-shaped recesses which widen and become deeper in the designated rolling direction.

In the method according to the invention, the two flat rolling jaws are displaced relative to each other, with the blank being received between the flat rolling jaws. The blank thereby rolls along the two flat rolling jaws and is thereby simultaneously deformed. The deformation takes place gradually from the cylindrical, in particular circular-cylindrical, blank to the ball-like sections by means of the expanding, channel-shaped recesses. As explained, approximately 10 to 15 revolutions of the blank are sufficient to completely shape the connecting element.

In a development of the invention, the two channel-shaped recesses are separated by means of a central web running parallel to the designated rolling direction.

By means of such a central web, a constriction is formed between the two ball-like sections of the connecting element during the rolling and therefore the relative movement between the blank, on the one hand, and the two flat rolling jaws, on the other hand. Alternatively, a connecting section can be formed between the two ball-like sections by means of the central web.

The problem on which the invention is based is also solved by a connecting element comprising at least two ball-like sections, wherein two ball-like sections are directly adjacent to each other, or wherein two ball-like sections are connected to each other by means of a connecting section, wherein the connecting element is produced from a single-piece blank by means of rolling between at least two rolling tools.

In a development of the invention, two ball-like sections are directly adjacent to each other and are separated from each other by means of a constriction, wherein, at the thinnest point of the constriction, a diameter of the connecting element is between one third and half of a diameter of the ball-like sections.

Such a dimensioning of the constriction firstly achieves a secure connection of the two ball-like sections and secondly it can also be ensured that the ball-like sections can each be clipped into a clip element which then surrounds the ball-like sections over an angle of more than 180° and is thereby then held securely on the ball-like section.

The problem on which the invention is based is also solved by a rolling tool for producing a connecting element with the method according to the invention, in which the rolling tool has two flat rolling jaws, wherein each flat rolling jaw has two channel-shaped recesses which widen and become deeper in the designated rolling direction.

In a development of the invention, the two channel-shaped recesses are separated by means of a central web running parallel to the designated rolling direction.

In a development of the invention, at least one of the channel-shaped recesses on its side opposite the central web is provided, at least in an end section having the greater width and depth of the recess, with a separating edge which extends beyond a central longitudinal axis of the produced connecting element in order to cut off a slug.

By means of such a separating edge, it is possible, during the final revolution or else the final revolutions in the rolling operation, to cut off the slug at the same time. For example, the separating edge extends over an angle of 180° in the case of spherical sections. If, therefore, the virtually finished connecting element on which the slug is still hanging is moved into the region of the separating edge, as the virtually finished connecting element rolls further along the two flat rolling jaws the separating edge ensures that the slug is cut off.

In a development of the invention, the central web has a substantially constant width over the entire length of the respective flat rolling jaw.

BRIEF DESCRIPTION OF THE DRAWINGS

Further features and advantages of the invention emerge from the claims and the description below of a preferred embodiment of the invention in conjunction with the drawings. Individual features shown in the drawings and described in the description can be combined with one another in any way without going beyond the scope of the invention. The same also applies to the combination of individual features without further individual features with which they are shown in conjunction or are described. In the drawings:

DETAILED DESCRIPTION

Figure 1:
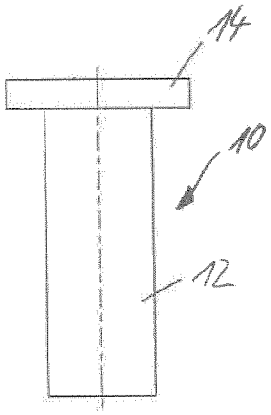
FIG. 1 shows a side view of a blank for producing a connecting element with the method according to the invention.

FIG. 1 shows, in a side view, a blank 10 for producing a connecting element with the method according to the invention. The blank 10 has a circular-cylindrical basic body 12 and a disk-like supply section 14. The disk-like supply section 14 projects in the radial direction beyond the circular-cylindrical basic body 12. The supply section 14 serves to hold the blank 10 as the blank 10 is being supplied to a rolling tool and optionally also to guide same during the beginning of the rolling operation. The supply section 14 is automatically cut off at the end of the rolling in the case of the method according to the invention. This will also be explained below.

The circular-cylindrical basic body 12 is deformed during the rolling to form two ball-like sections of the connecting element and optionally a connecting section between the two ball-like sections. A slug, see FIG. 3, arises at both ends of the circular-cylindrical basic body 12 during the rolling, the slug receiving excess material and being automatically cut off at the end of the rolling.

Figure 2:
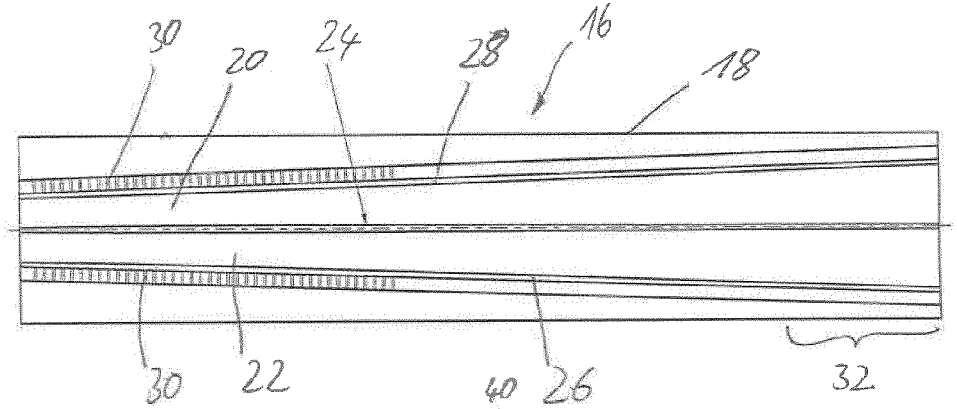
FIG. 2 shows a top view of a flat rolling jaw of a rolling tool for use in the method according to the invention.

FIG. 2 shows a top view of a flat rolling jaw 16 for use in the method according to the invention. For the production of a connecting element use is made of two identical flat rolling jaws 16 which accommodate the blank 10 between them and are then displaced relative to each other. This displacement movement causes the blank 10 to then roll along the flat rolling jaw 16, from the left to the right in FIG. 2, and, in the process, said blank is simultaneously deformed between the two flat rolling jaws to form the connecting element according to the invention. The deformation takes place by means of rolling and, as a result, by cold forming.

Figure 4:
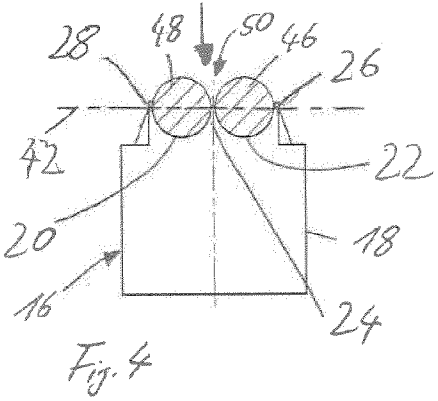
FIG. 4 shows a schematic sectional view of the flat rolling jaw of FIG. 2 with a connecting element according to the invention arranged therein.

The flat rolling jaw 16 has a basic body 18 in the form of an elongated cuboid, also see FIG. 4. The upper side of the basic body 18 is provided with two channel-shaped recesses 20, 22 which widen and become deeper in the designated rolling direction, i.e. from the left to the right in FIG. 2. The two channel-shaped recesses 20, 22 are separated from each other over their entire length by a central web 24, also see FIG. 4. The central web 24 has a constant width over the entire length of the flat rolling jaw 16.

The inner edges of the channel-shaped recesses 20, 22, which edges are formed by the central web 24 both in the case of the channel-shaped recess 12 and in the case of the channel-shaped recess 22, therefore lie parallel to each other. By contrast, the respective outer edges 26, 28 run apart from each other in the designated rolling direction, i.e. from the left to the right in FIG. 2.

In the left section of the channel-shaped recesses 20, 22 in FIG. 2, apart from the side edges 26, 28 there are in each case also a plurality of consecutively arranged ribs 30. The ribs 30 each form a carry-along track which, however, extends parallel to the channel-shaped recesses 20, 22 only between approximately one third and half of the length thereof. The ribs 30 which form the carry-along tracks serve at the beginning of the rolling operation to carry along the blank such that the latter does not slide relative to the flat rolling jaws 16, but rather rolls along the flat rolling jaws 16.

Figure 3:
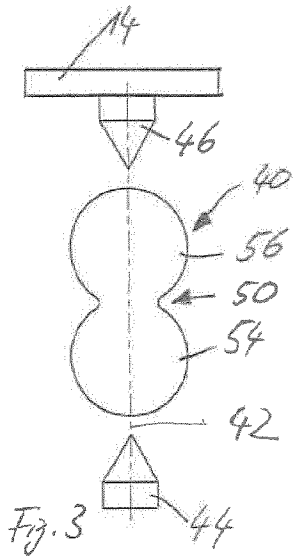
FIG. 3 shows a schematic top view of a connecting element according to the invention with two slugs already cut off.

In the method according to the invention, the blank 10 is completely deformed to form the connecting element 40, which is illustrated in FIG. 3, over the course of approximately 10 to 15 revolutions relative to the flat rolling jaws 16.

In an end section 32 of the flat rolling jaws 16, into which end section the blank therefore passes only over the course of the final revolution or final two revolutions relative to the flat rolling jaws 16, the side edges 26, 28 of the flat rolling jaws 16 are designed as separating edges and extend beyond the center longitudinal axis of the blank 10 or of the virtually finished connecting element 40. The finished connecting element 40 and the center longitudinal axis 42 thereof can be seen in the illustration of FIG. 3. A respective slug 44, 46 can be seen above and below the connecting element 40, wherein the slug at the top in FIG. 3 is still connected to the supply section 14. During the shaping of the connecting element 40 from the circular-cylindrical basic body 12 of the blank 10, the slugs 44, 46 form outside the channel-shaped recesses 20, 22 since excess material is forced out of the channel-shaped recesses 20, 22 and flows into the slugs 44, 46. When the blank 10 enters into the region of the end section 32 of the channel-shaped recesses 20, 22, see FIG. 2, said slugs are still connected integrally to the blank 10. Since now in the end section 32 the outer side edges of the channel-shaped recesses 20, 22 extend beyond the center longitudinal axis 42 of the connecting element 40 and are each designed as a separating edge, the slugs 44, 46 are cut off from the connecting element 40 during the rolling along of the blank 10 or of the virtually finished connecting element 40. After the connecting element 40 then leaves the end section 32, the state of FIG. 3 is reached. As can be seen, the connecting element 40 is completely shaped and the slugs 44, 46 have been automatically cut off from the connecting element 40. In the case of two identical flat rolling jaws 16, in each case only one side edge, for example the side edge 28, is designed as the separating edge. Since the two flat rolling jaws 16 are placed onto each other, the separating edge on the lower flat rolling jaw 16 can cut off one slug and the separating edge on the upper flat rolling jaw can cut off the other slug.

It can be seen with reference to FIG. 3 that the connecting element 40 has a first ball-like section 46 and a second ball-like section 48 which each have the same diameter and are separated from each other by a constriction 50. The two ball-like sections 54, 56 are connected integrally to each other in the region of the constriction 50 since they have been formed by cold forming during the rolling of the blank 10. The diameters of the two ball-like sections 54, 56 are identical in size and the diameter in the region of the constriction 50 is approximately one third to half of the diameters of the ball-like sections 54, 56.

The connecting element 40 is used for connecting two workpieces. For this purpose, the two workpieces are each connected to a clip element which has a ball-like recess matching the ball-like sections 54, 56 and is composed of an elastically flexible material, for example a suitable plastic. The ball-like section 54 of the connecting element 40 is then clipped into the clip element of the first workpiece and the ball-like section 56 into the clip element of the second workpiece. The two workpieces are then securely connected to each other via the connecting element 40.

It can be seen with reference to the illustration of FIG. 4 how, during the rolling, the constriction 50 between the two ball-like sections 54, 56 of the connecting element 40 is formed by the central web 24. The central web 24 is pressed into the cylindrical basic body 12 of the blank 10 and, during the rolling of the blank 10 along the flat rolling jaw 16, displaces material to the left and right into the spherical sections 54, 56.

The illustration of FIG. 4 is schematic. During the rolling, the blank 10 lies between two flat rolling jaws 16, with an upper flat rolling jaw not being illustrated in FIG. 4 for the sake of clarity.

FIG. 4 schematically shows the state in which the connecting element 40 is already completely shaped and the connecting element 40 is therefore located in the end section 32 of the channel-shaped recesses 20, 22, cf. FIG. 2. In this state, the slugs 44, 46, cf. FIG. 3, have already been completely cut off. For this purpose, the side edges 26, 28 extend beyond the center longitudinal axis 42 of the connecting element 40 in the end region 32.

The method according to the invention makes it possible to completely form the connecting element 40 in a single rolling operation. The slugs 44, 46 are severed at the end of said rolling operation, and therefore the connecting element 40 is then completely finished.

Figure 5:
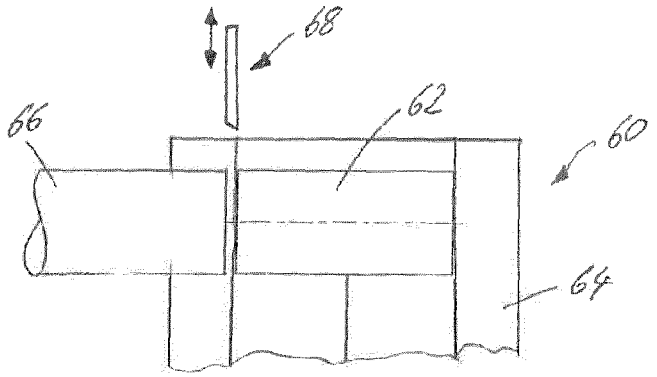
FIG. 5 shows a schematic partial top view of a rolling tool for producing a connecting element according to the invention according to a further embodiment of the invention.

The illustration of FIG. 5 shows a schematic partial top view of a rolling tool 60 according to a further embodiment of the invention, with just one flat rolling jaw 64 lying below a blank 62 in the illustration of FIG. 5 being illustrated. The flat rolling jaw 64 is substantially identical to the flat rolling jaw of FIG. 2. However, the blank 62 does not have a supply section and, on the contrary, at the beginning of the rolling track of the flat rolling jaw 64, is cut off to the necessary length from a supplied wire 66, for example from a wire coil, by means of a separating tool 68, illustrated schematically. The separating tool 68 can be, for example, in the form of guillotine shears, a saw or the like. The cutting off of the cylindrical blank 62 only when the blank 62 is already arranged in the rolling tool 60 considerably facilitates the handling of the blank 62, particularly the wire 66 is supplied, for example, from a wire coil. As long as the blank 62 is still connected to the rest of the wire 66, the blank can easily be introduced between two flat rolling jaws of the rolling tool 60. Only when the end section of the wire 66 that subsequently forms the blank 62 is positioned correctly relative to the rolling tool 60 and particularly, see FIG. 5, is arranged at the beginning of the rolling track of the flat rolling jaws 64 is the blank 62 cut off from the rest of the wire 66 by means of the separating tool 68.

Figure 6:
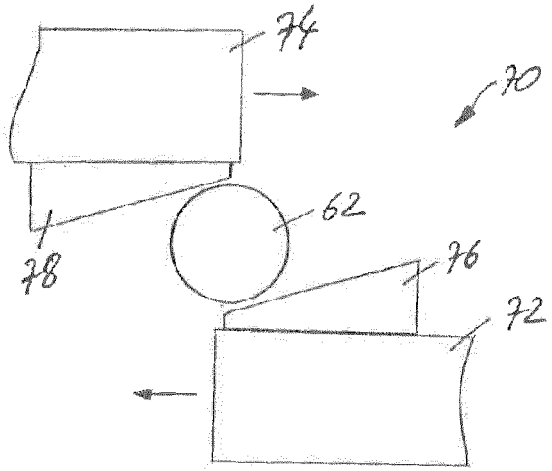
FIG. 6 shows a schematic partial side view of a further rolling tool according to the invention for producing the connecting element according to the invention.

FIG. 6 shows a partial side view of a rolling tool 70 according to a further embodiment of the invention. The rolling tool 70 has a lower flat rolling jaw and an upper flat rolling jaw 74, which can be identical to each other and receive the cylindrical blank 62 between each other. The blank 62, as has been explained with reference to FIG. 5, can form the free end of a wire 66.

The two flat rolling jaws 72, 74 are provided with a respective separating edge 76, 78, said separating edges being provided in order, at the beginning of the rolling movement, to cut off a piece of the wire and to thereby form the blank 62. As indicated in FIG. 6, the lower flat rolling jaw 72 is moved to the left and the upper flat rolling jaw 74 to the right. A height of the separating edge 76 of the lower flat rolling jaw 72 increases from the left to the right in FIG. 6 and a height of the separating edge 78 of the upper flat rolling jaw 74 increases from the right to the left in FIG. 6. If the two flat rolling jaws 72, 74 are therefore moved horizontally to the left and right, respectively, in FIG. 6, the separating edges 76 and 78 penetrate the material of the wire and the blank 62 is then completely cut off from the wire at the respective higher end of the separating edges 76, 78. As a result, the blank 62 does not have to be held by separate devices, but rather is moved as the free end of a wire into the position, illustrated in FIG. 6, between the two flat rolling jaws 72, 74. If the flat rolling jaws 72, 74 are then moved to the left and right, respectively, in accordance with the arrows indicated in FIG. 6, the blank 62 is already clamped between the flat rolling jaws 72, 74. After the blank 62 is cut off from the wire, the blank 62 is then securely held between the two flat rolling jaws 72, 74.

Figure 7:
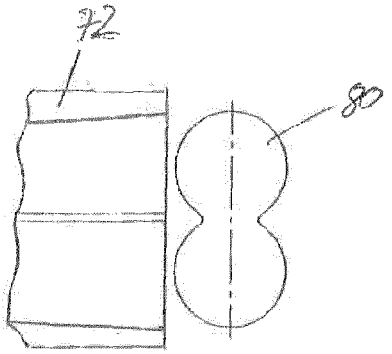
FIG. 7 shows a partial schematic top view of a flat rolling jaw of a rolling tool and a connecting element according to the invention produced therewith.

FIG. 7 shows a schematic partial top view of a connecting element 80 according to the invention and an end section of a flat rolling jaw 72. The flat rolling jaw 72 is identical to the flat rolling jaw 16 of FIG. 2. In contrast to FIG. 3, the connecting element 80 according to the invention is, however, produced from a blank 62 without waste, cf. FIG. 5 and FIG. 6. In particular, the blank 62 is deformed to form the connecting element without slugs arising. For this purpose, the blank 62, as illustrated in FIGS. 5 and 6, can be, for example, cylindrical and in the form of a section of a wire 66.

Figure 8:
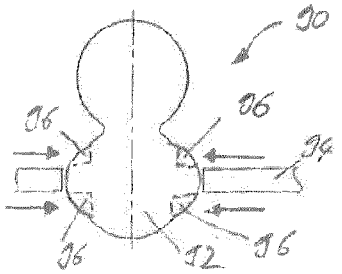
FIG. 8 shows a connecting element according to a further embodiment of the invention.

FIG. 8 schematically shows a further connecting element 90 according to the invention. The ball-like section 92 at the bottom in FIG. 8 is more bulbous in the central region than the upper ball-like section. If the connecting element 90 is pressed directly into a passage opening in a metal sheet 94, in the regions 96 marked by dashed lines which are pressed inward in accordance with the arrows in FIG. 8 during the pressing-in operation, sufficient material is available in order to securely anchor the ball-like section 92 in the metal sheet 94.

The invention claimed is:

1. A method for producing a connecting element comprising at least two spherical sections, wherein two spherical sections are directly adjacent to each other, or wherein two spherical sections are connected to each other by means of a connecting section, the method comprising rolling a single-piece blank, which is cylindrical at least in sections, between at least two rolling tools and shaping portions of the single-piece blank into the at least two spherical sections and optionally the connecting section during the rolling, further including holding the blank at least before the beginning of the rolling at a supply head of the blank and prior to the insertion of the blank between the at least two rolling tools, wherein the supply head consists of a disk at a first terminal end of the blank that it is wider than it is tall and projects in the radial direction to a supply head radius that is greater than a body radius for the body section of the blank which is cylindrical and extends from the supply head to a second terminal end of the blank.

2. The method as claimed in claim 1, wherein the shaping takes place over the course of 10 to 15 revolutions of the blank.

3. The method as claimed in claim 1, further including cutting off a respective slug from the outer ends of the spherical sections at the end of the rolling operation by means of a separating edge on a rolling tool, which separating edge extends beyond the center longitudinal axis of the connecting element.

4. The method as claimed in claim 3, further including cutting off the supply head together with cutting off one of the slugs.

5. The method as claimed in claim 1, wherein the blank has a circular-cylindrical body except for the supply head.

6. The method as claimed in claim 1, wherein each rolling tool is a flat rolling jaw.

7. The method as claimed in claim 6, wherein each flat rolling jaw has two channel-shaped recesses which widen and become deeper in the designated rolling direction.

8. The method as claimed in claim 7, wherein the two channel-shaped recesses are separated by means of a central web running parallel to the designated rolling direction.

9. The method as claimed in claim 1, wherein holding the supply head of the blank includes holding the blank at the first terminal end of the blank.

* * * * *